US011215062B2

(12) United States Patent
Hartung et al.

(10) Patent No.: US 11,215,062 B2
(45) Date of Patent: Jan. 4, 2022

(54) BLADE ARRANGEMENT WITH DAMPER FOR TURBOMACHINE

(71) Applicant: MTU Aero Engines AG, Munich (DE)

(72) Inventors: Andreas Hartung, Munich (DE); Martin Pernleitner, Dachau (DE)

(73) Assignee: MTU Aero Engines AG, Munich (DE)

( * ) Notice: Subject to any disclaimer, the term of this patent is extended or adjusted under 35 U.S.C. 154(b) by 298 days.

(21) Appl. No.: 16/709,515

(22) Filed: Dec. 10, 2019

(65) Prior Publication Data

US 2020/0240277 A1 Jul. 30, 2020

(30) Foreign Application Priority Data

Dec. 12, 2018 (DE) ..... 10 2018 221 533.2

(51) Int. Cl.
*F01D 5/22* (2006.01)

(52) U.S. Cl.
CPC ..... *F01D 5/22* (2013.01); *F05D 2220/32* (2013.01); *F05D 2260/96* (2013.01)

(58) Field of Classification Search
CPC ..... F01D 5/10; F01D 5/16; F01D 5/22; F01D 5/26; F01D 25/04; F01D 25/06
See application file for complete search history.

(56) References Cited

U.S. PATENT DOCUMENTS 3,037,741 A 6/1962 Tuft
4,457,668 A 7/1984 Hallinger
5,302,085 A * 4/1994 Dietz ..... F01D 5/22 416/220 R
5,478,207 A * 12/1995 Stec ..... F01D 5/3007 416/219 R
5,749,705 A * 5/1998 Clarke ..... F01D 5/26 416/190
5,924,699 A * 7/1999 Airey ..... F01D 11/008 277/411
6,450,769 B2 9/2002 Szwedowicz
6,776,583 B1 * 8/2004 Wang ..... F01D 5/22 416/220 R
7,534,090 B2 * 5/2009 Good ..... F01D 5/10 415/119

(Continued)

FOREIGN PATENT DOCUMENTS

DE 102010052965 B4 6/2014
DE 102016221069 A1 4/2018

(Continued)

*Primary Examiner* — Topaz L. Elliott
(74) *Attorney, Agent, or Firm* — Barlow, Josephs & Holmes, Ltd.; David R. Josephs

(57) ABSTRACT

A blade arrangement for a turbomachine, in particular a gas turbine, with a first blade, which has a first blade body and a first platform, and a second blade, which is adjacent in the peripheral direction, and has a second blade body and a second platform. A first wall of the first blade and a second wall of the second blade bound a blade cavity, in which a damper with a wall-side contact surface is arranged. This contact surface has at least one first surface portion, which is convexly curved in a first direction, which, in at least one contact position, contacts the first wall in the first surface portion and is parallel to at least one portion of an edge of the first platform, said edge facing the second platform.

17 Claims, 2 Drawing Sheets

(56) References Cited

U.S. PATENT DOCUMENTS

| | | | | |
|---|---|---|---|---|
| 8,113,783 | B2 * | 2/2012 | Mace | F01D 5/22 416/190 |
| 9,982,559 | B2 * | 5/2018 | Hartung | F01D 5/10 |
| 10,526,896 | B2 * | 1/2020 | Hartung | F01D 9/02 |
| 10,526,901 | B2 * | 1/2020 | Schlemmer | F01D 5/147 |
| 10,570,752 | B2 * | 2/2020 | Roesele | F16F 7/10 |
| 10,689,983 | B2 * | 6/2020 | Schlemmer | F01D 5/10 |
| 2007/0286732 | A1 * | 12/2007 | Good | F01D 5/26 416/190 |
| 2009/0123286 | A1 * | 5/2009 | Mace | F04D 29/322 416/193 A |
| 2010/0061854 | A1 * | 3/2010 | Townes | F01D 5/22 416/95 |
| 2012/0141296 | A1 * | 6/2012 | Bilz | F01D 5/323 416/244 R |
| 2013/0108467 | A1 * | 5/2013 | Berche | F01D 11/008 416/96 R |
| 2013/0287583 | A1 * | 10/2013 | Schoenhoff | F01D 5/22 416/223 R |
| 2015/0226077 | A1 * | 8/2015 | Beattie | F01D 5/22 416/174 |
| 2016/0138401 | A1 * | 5/2016 | Hartung | F01D 9/041 415/119 |
| 2016/0146041 | A1 * | 5/2016 | Hartung | F01D 25/06 415/119 |
| 2016/0153303 | A1 * | 6/2016 | Hough | F01D 5/22 416/193 A |
| 2017/0067347 | A1 * | 3/2017 | Kareff | F01D 5/22 |
| 2017/0266745 | A1 * | 9/2017 | Richter | B23K 1/002 |
| 2017/0314397 | A1 * | 11/2017 | Hartung | F04D 29/668 |
| 2017/0321557 | A1 * | 11/2017 | Roesele | F16F 7/10 |
| 2017/0335695 | A1 * | 11/2017 | Schlemmer | F01D 5/26 |
| 2018/0119552 | A1 * | 5/2018 | Schlemmer | F01D 5/26 |
| 2018/0187562 | A1 * | 7/2018 | Thistle | F01D 5/22 |
| 2018/0230818 | A1 * | 8/2018 | Chakrabarti | F01D 5/22 |
| 2019/0017402 | A1 * | 1/2019 | Martin, Jr. | F01D 5/22 |

FOREIGN PATENT DOCUMENTS

| | | | | | |
|---|---|---|---|---|---|
| EP | 0702131 | B1 | | 12/1998 | |
| EP | 1600606 | A1 | | 11/2005 | |
| EP | 2163725 | A2 | | 3/2010 | |
| EP | 2455587 | A1 | | 5/2012 | |
| EP | 2484870 | A1 | * | 8/2012 | F01D 5/16 |
| EP | 1867836 | B1 | | 4/2014 | |
| EP | 2848770 | A1 | * | 3/2015 | F01D 5/22 |
| EP | 3020922 | A1 | | 5/2016 | |
| EP | 3098387 | A1 | | 11/2016 | |
| JP | 2006125372 | A | | 5/2006 | |
| JP | 2008303794 | A | * | 12/2008 | F01D 5/22 |
| WO | 2012095067 | A1 | | 7/2012 | |
| WO | 2014051688 | A1 | | 4/2014 | |
| WO | WO-2019115886 | A1 | * | 6/2019 | F01D 5/10 |
| WO | WO-2020090169 | A1 | * | 5/2020 | F04D 29/66 |
| WO | WO-2020131062 | A1 | * | 6/2020 | F04D 29/666 |

* cited by examiner

BLADE ARRANGEMENT WITH DAMPER FOR TURBOMACHINE

BACKGROUND OF THE INVENTION

The present invention relates to a blade arrangement for a turbomachine, in particular a gas turbine, a turbomachine, particularly a gas turbine, having the blade arrangement, and a method for reducing vibrations of the blade arrangement.

Blades of turbomachines can have various vibrational modes during operation. In particular, on the one hand, so-called flap modes ("F mode") of the blades can cause a tilting of the blades or of the platforms around the main axis or rotational axis of the turbomachine, and, on the other hand, so-called couple disk modes ("CD mode") can cause a pitching of the blades or of the platforms in the direction of a line of a separation line between the platforms.

SUMMARY OF THE INVENTION

An object of one embodiment of the present invention is to reduce vibrations of blade arrangements.

This object is achieved by a blade arrangement and by a method of the present invention. The object is also achieved by a turbomachine with one or a plurality of blade arrangements described here. Advantageous embodiments of the invention are discussed in detail below.

In accordance with one embodiment of the present invention, a blade arrangement (at least one blade arrangement) for or of a turbomachine, in one embodiment for or of a gas turbine, particularly an aircraft engine, has a blade with a blade body and at least one platform as well as an adjacent (adjacently arranged) other blade with a blade body and at least one platform, wherein, in the present case, without loss of generality, these two blades are referred to as first blade and second blade, and their blade body and their platform are correspondingly referred to as, respectively, first blade body and first platform (of the first blade) and as, respectively, second blade body and second platform (of the second blade).

In one embodiment, the blades are rotating blades and/or blades of a compressor stage or turbine stage of a gas turbine, in particular of an aircraft engine, and/or have blade roots, which are fastened, in particular, in a detachable manner and/or in a form-fitting manner and/or in a friction-fitting manner, in a carrier, particularly a rotor of the turbomachine, or are provided, in particular set up, or are used for this purpose.

Based on the conditions of application, the present invention can be used here especially advantageously.

In accordance with one embodiment of the present invention, a wall of the first blade ("first wall") and a wall of the second blade ("second wall") bound a blade cavity, in which a one-piece or multipiece damper is or will be arranged, which has a wall-side contact surface, which, during operation, contacts the first and second wall at least temporarily, or is provided, in particular set up, or is used for this purpose.

In accordance with one embodiment of the present invention, this contact surface has a surface portion, which, in the present case, without loss of generality, is referred to as first surface portion and is convexly curved (as viewed) in a first direction, which, in at least one contact position in which this first surface portion contacts the first wall, is parallel to at least one portion of an edge, particularly of an edge on the side of the blade body or on the side of the flow channel, or upper edge, of the first platform that faces the second platform. In other words, the contact surface has a first surface portion, which is convexly curved in the direction of at least one portion of a (blade-body-side or flow-channel-side or upper) edge of the first platform that faces the second platform or of a line of separation between the first and second platform when the damper or its first surface portion is situated in the contact position.

In one embodiment, this portion of the edge is at least 10%, in particular at least 25%, and, in one embodiment, at least 50% of a (total) length of the edge or line of separation; in particular, it can also be 100%. In one embodiment, the line of separation can be gap-like, in particular so as to compensate for tolerances, thermal expansions, movements, or the like. Accordingly, in one embodiment, the first platform (or the edge of the first platform facing the second platform) does not touch the second platform (during normal operation) or is provided, in particular set up, for this purpose. In another embodiment, the first platform (or the edge of the first platform facing the second platform) and the second platform can touch at least temporarily, so that the line of separation forms a line of contact between the first platform and the second platform. Accordingly, in one embodiment, the first direction in the at least one contact position in which the first surface portion contacts the first wall is parallel to at least one portion of a line of separation between the first platform and the second platform, in particular a portion of a temporary or even only virtual or theoretical line of contact between the first platform and the second platform (defined by the edge of the first platform that faces the second platform), wherein, in one embodiment, this portion is at least 10%, in particular at least 25%, in one embodiment at least 50%, of a (total) length of the line of separation or the (temporary or (only) virtual or theoretical) line of contact and, in particular, can also be 100%.

As explained in the introduction, couple disk modes can cause a pitching of the blades or of the platforms in the direction of the line of separation. Since the damper or its contact surface in the first surface portion is parallel to at least one portion of the edge of the first platform facing the second platform, or the line of separation defined thereby between the first platform and the second platform is convexly curved, it is advantageously possible in one embodiment, as a result of the relative movement (promoted thereby) of the first blade and the second blade with respect to each other, to dissipate vibrational energy through a friction-laden sliding movement (promoted thereby) of the damper or of its contact surface, and thus corresponding vibrations of the blade arrangements will be reduced.

In one embodiment, the first surface portion is additionally convexly curved also (as viewed) in the peripheral direction when the damper is situated in the contact position.

As explained in the introduction, flap modes can cause a tilting of the blades or of the platforms around the main axis or rotational axis in the peripheral direction. Since the damper or its contact surface in the first surface portion is also convexly curved in the peripheral direction, it is advantageously possible in one embodiment, as a result of a (thereby promoted) relative movement of the first blade and the second blade with respect to each other, to dissipate vibrational energy through a (thereby promoted) friction-laden sliding movement of the damper or its contact surface, and thus corresponding vibrations of the blade arrangements will be reduced.

In an alternative embodiment, the first surface portion is straight (as viewed) in the peripheral direction when the damper is situated in the contact position.

It is thereby possible in one embodiment to hamper any sliding movement between the first surface portion and the first wall, or to enlarge a surface of contact, and the damper will thereby be better supported against the first wall.

In particular, it is then possible, particularly in regard to the above-mentioned flap modes or the tilting of the blades or of the platforms around the main axis or rotational axis or in the peripheral direction, to provide advantageously that the contact surface has a further surface portion, which, in the present case, without loss of generality, is referred to as a second surface portion and which contacts the second wall when the damper is situated in the contact position, or is provided, in particular set up, or is used for this purpose, and, then or in the contact position, is convexly curved (as viewed) in the peripheral direction.

It is thereby possible in one embodiment to promote a tilting of the blades or of the platforms around the main axis or rotational axis or in the peripheral direction and thereby, through a (thereby promoted) friction-laden sliding movement of the damper or of its contact surface, to dissipate the vibrational energy of flap modes, and thus corresponding vibrations of the blade arrangements will be reduced.

As a result of the straight first surface portion in the contact position (as viewed) in the peripheral direction, it is thereby advantageously possible, as explained, to support the damper against the first wall, wherein the convexly curved second surface portion in the contact position (as viewed) in the peripheral direction is not limited to this, but can advantageously reduce vibrations also in combination with a convexly curved first surface portion in the contact position (as viewed) in the peripheral direction.

Additionally or alternatively, it may be advantageous, particularly for a convexly curved first surface portion in the contact position, both in the first direction and (as viewed) in the peripheral direction, to provide a or the (second) surface portion of the contact surface, which contacts the second wall in the contact position and is straight in the first direction and/or (as viewed) in the peripheral direction. In this case, said second surface portion can be, in particular, flat or planar in design.

It is thereby possible in one embodiment to hamper any sliding movement between this second surface portion and the second wall, and thereby to better support the damper against the second wall.

In one embodiment, the damper has one damper cavity or a plurality of damper cavities, in which (in each case) at least one, and in a preferred embodiment (in each case) exactly one, impact body, which, in a preferred embodiment, is spherical, is or will be arranged, and, during operation, makes impact contacts with the damper cavity wall or is provided, in particular set up, or is used for this purpose.

This is based on a concept, which is fundamentally known from WO 2012/095067 A1, for reducing blade vibrations through impact contacts, as a result of which, in particular, resonance frequencies of blades (blade arrangements) can be detuned. For this purpose, reference is supplementally made to the cited WO 2012/095067 A1, which is hereby incorporated by reference in its entirety herein.

As has been surprisingly found, it is possible, in combination with the above-described contact surface, to transmit impulses between impact bodies, dampers, and blades in an especially advantageous manner, and thereby advantageously to reduce blade vibrations. It is assumed that this is especially promoted by the sliding movements in the corresponding directions promoted or hampered thereby, but without being bound to this assumption.

In one embodiment, the impact body or one impact body or a plurality of impact bodies is or are arranged or will be arranged in the (respective) damper cavity in an airtight or gastight manner.

It is thereby possible, owing to impact contact, to reduce blade vibrations especially advantageously.

In one embodiment, the damper cavity or one damper cavity or a plurality of damper cavities is or are or will be (in each case, in particular, jointly) sealed, in one embodiment in an airtight manner, by a cover, which is arranged on a side of the damper that lies opposite the contact surface.

It is thereby possible in one embodiment to improve (further) the impulse transmission between impact bodies, dampers, and blades.

In one embodiment, the first platform and second platform are platforms on the side of the blade root and therefore, in particular, radially inner-lying and/or lower platforms.

Additionally or alternatively, in one embodiment, the blade cavity is arranged on a side of the first and/or second platform that faces away from the blade body, and in one embodiment, is arranged entirely or partially in the first and/or second platform.

It has been surprisingly found that, in this way, it is possible to reduce blade vibrations especially advantageously.

In one embodiment, the axial direction is parallel to a rotational axis or main machine axis, a peripheral direction is correspondingly a rotational direction around this axis, and a radial direction is perpendicular to both the axial direction and peripheral direction.

BRIEF DESCRIPTION OF THE DRAWING FIGURES

Other advantageous enhancements of the present invention ensue from the dependent claims and the following description of preferred embodiments. Shown partially schematically for this purpose are:

DESCRIPTION OF THE INVENTION

Figure 1:
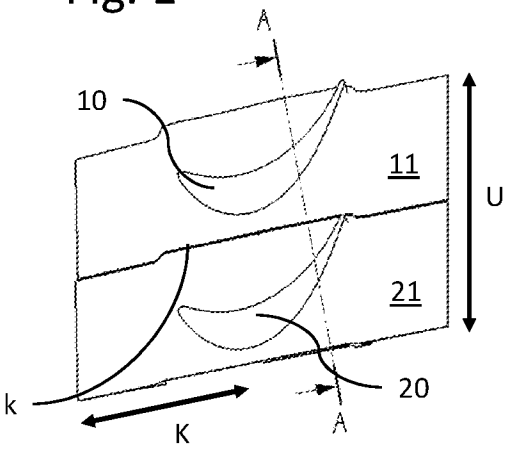
FIG. 1 shows a blade arrangement in accordance with an embodiment of the present invention in radial view from the top.
Figure 2:
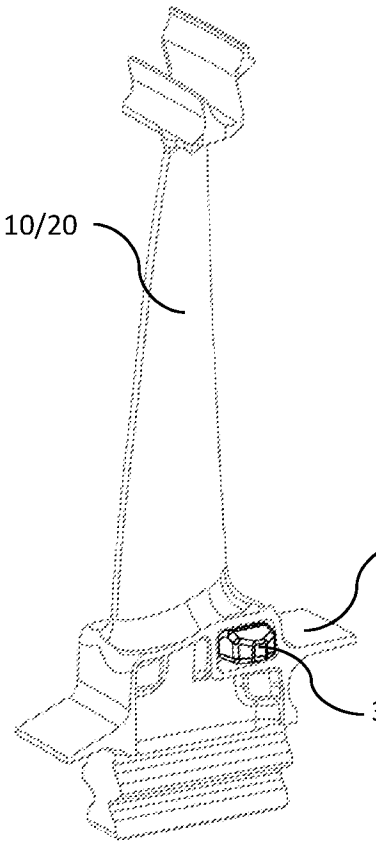
FIG. 2 shows a blade of the blade arrangement in perspective view.

FIG. 1 shows a blade arrangement in accordance with an embodiment of the present invention in radial view from the top and FIG. 2 shows one of the two identically constructed blades of the blade arrangement in perspective view.

The two blades each have a blade body 10 and 20, respectively, and a platform 11 and 21, respectively, on the side of the blade root.

Figure 3:
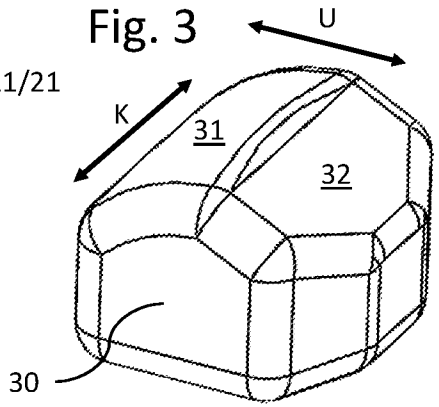
FIG. 3 shows a damper of the blade arrangement in enlarged perspective view.
Figure 4:
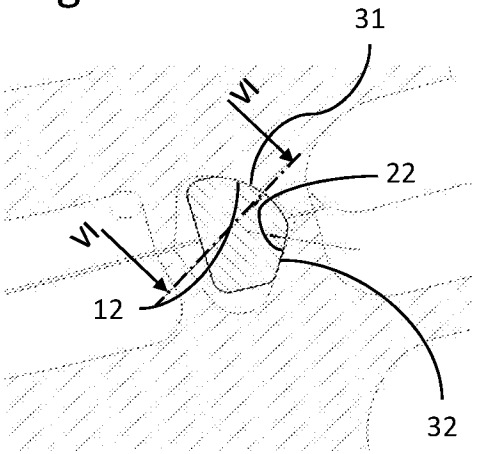
FIG. 4 shows an excerpt along line A-A in FIG. 1.

In the two platforms, a damper 30, which is bounded by corresponding walls 12 and 22, respectively (compare FIG. 4), is arranged in a blade cavity, as viewed in FIG. 3 onto its wall-side contact surface.

Figure 6:
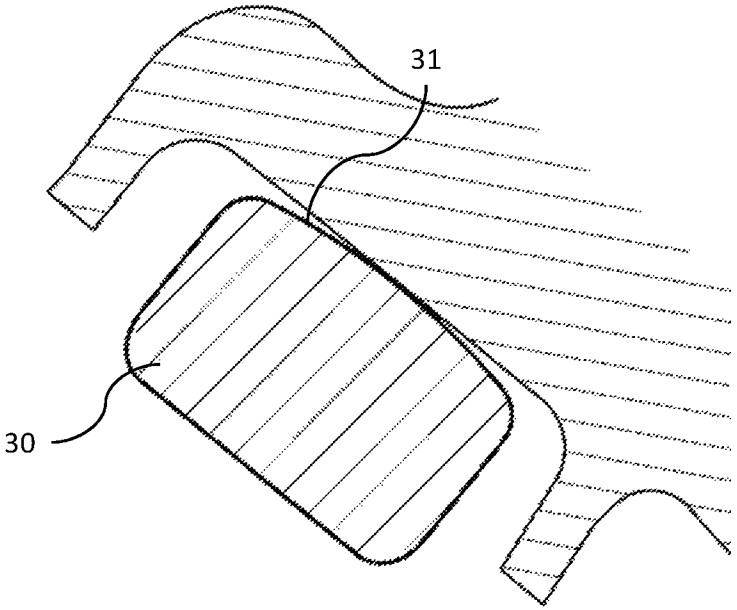
FIG. 6 shows an excerpt along line VI-VI in FIG. 4.

This contact surface has a first surface portion 31, which is convexly curved in a first direction K, which, in a contact position in which a first surface portion contacts the wall of the one blade (compare FIG. 4), is parallel to the edge k of the first platform 11 that faces the second platform 21 or to the line of separation between the first platform and the second platform. For clarification, FIG. 6 shows an excerpt along the line of section VI-VI drawn in a dot-dash manner in FIG. 4.

In the exemplary embodiment, the first surface portion in the contact position is also convexly curved in the peripheral direction U, and the contact surface has a second surface portion 32, which, in the contact position, contacts the wall of the other blade and is straight in the first direction K and in the peripheral direction U.

Conversely, in a modification that is not illustrated, the first surface portion 31 in the contact position is straight in the peripheral direction U and the second surface portion 32 is convexly curved in the peripheral direction.

Figure 5:
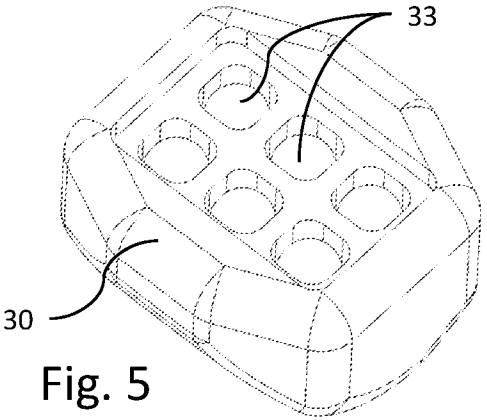
FIG. 5 shows the damper from another perspective.

As can be seen in the rear view (from radially inward) of FIG. 5, the damper 30 has a plurality of damper cavities 33, in which, in each case, an impact body (not visible in FIG. 5) is arranged for impact contact with the respective damper cavity wall.

The damper cavities are or will be airtight owing to a cover (not visible in FIG. 5).

Even though exemplary embodiments have been explained in the preceding description, it is noted that a large number of modifications are possible. Moreover, it is noted that what is involved in the exemplary embodiments are merely examples, which are not intended to limit the protective scope, the applications, and the structure in any way. Instead, the preceding description affords the person skilled in the art a guideline for implementing at least one exemplary embodiment, whereby diverse changes, in particular in regard to the function and arrangement of the described component parts, can be made without leaving the protective scope as ensues from the claims and combinations of features equivalent to these claims.

What is claimed is:

1. A blade arrangement for a turbomachine, having a first blade, which has a first blade body and a first platform, and a second blade, which is adjacent in a peripheral direction and has a second blade body and a second platform, wherein a first wall of the first blade and a second wall of the second blade bound a blade cavity, in which a damper with a wall-side contact surface is arranged, wherein this wall-side contact surface has at least one first surface portion convexly curved in a first direction in at least one contact position in which said at least one first surface portion contacts the first wall, wherein the contact surface has at least one second surface portion, which in the at least one contact position, contacts the second wall, and the at least one first surface portion and the at least one second surface portion have different geometries including different degrees of curvature in an axial direction of the turbomachine.

2. The blade arrangement according to claim 1, wherein the at least one first surface portion in the at least one contact position is also convexly curved in the peripheral direction.

3. The blade arrangement according to claim 2, wherein the at least one second surface portion is planar, and/or, in the first and/or peripheral direction, is straight.

4. The blade arrangement according to claim 1, wherein the at least one second surface portion is convexly curved in the peripheral direction.

5. The blade arrangement according to claim 1, wherein the damper has at least one airtight damper cavity, in which at least one impact body is arranged, in an airtight manner, for impact contact with the at least one damper cavity wall.

6. The blade arrangement according to claim 1, wherein the first platform is a platform on a side of a blade root of the first blade and the second platform is a platform on a side of a blade root of the second blade.

7. The blade arrangement according to claim 1, wherein the blade cavity is arranged on a side of the first and/or second platform that faces away from the blade body, at least partially in the first and/or second platform.

8. The blade arrangement according to claim 1, wherein the blade arrangement is configured and arranged in a turbomachine.

9. The blade arrangement according to claim 1, wherein the damper is arranged in the blade cavity in such a way that it can assume the at least one contact position and reduce vibrations.

10. A blade arrangement for a turbomachine, having a first blade, which has a first blade body and a first platform, and a second blade, which is adjacent in a peripheral direction and has a second blade body and a second platform, wherein a first wall of the first blade and a second wall of the second blade bound a blade cavity, in which a damper with a wall-side contact surface is arranged, wherein this contact surface has at least one first surface portion convexly curved in a first direction in at least one contact position, when in operation, said at least one first surface portion contacts the first wall, wherein the damper has at least one damper cavity, in which at least one impact body is arranged, in an airtight manner, for impact contact with the at least one damper cavity wall, and wherein the at least one damper cavity is sealed, in an airtight manner, by a cover wherein the at least one first surface portion in the at least one contact position is also convexly curved in the peripheral direction, and wherein the contact surface has at least one second surface portion, which, in the at least one contact position, contacts the second wall.

11. The blade arrangement according to claim 10, wherein the at least one second surface portion is planar, and/or, in the first and/or peripheral direction, is straight.

12. The blade arrangement according to claim 10, wherein the contact surface has at least one second surface portion, which, in the at least one contact position, contacts the second wall and is convexly curved in the peripheral direction.

13. The blade arrangement according to claim 10, wherein the first platform and second platform are platforms on a side of a blade root.

14. The blade arrangement according to claim 10, wherein the blade cavity is arranged on a side of the first and/or second platform that faces away from the blade body, at least partially in the first and/or second platform.

15. The blade arrangement according to claim 10, wherein the blade arrangement is configured and arranged in a turbomachine.

16. The blade arrangement according to claim 10, wherein the damper is arranged in the blade cavity in such a way that it can assume the at least one contact position and reduce vibrations.

17. The blade arrangement according to claim 10, wherein the cover is arranged on a side of the damper that lies opposite the contact surface.

* * * * *